US007211985B2

(12) United States Patent
Miehlich

(10) Patent No.: US 7,211,985 B2
(45) Date of Patent: May 1, 2007

(54) TRAINING DEVICE

(76) Inventor: Dieter Miehlich, An der Lauhna 2, Emersacker (DE) D-86494

( * ) Notice: Subject to any disclaimer, the term of this patent is extended or adjusted under 35 U.S.C. 154(b) by 0 days.

(21) Appl. No.: 11/176,231

(22) Filed: Jul. 8, 2005

(65) Prior Publication Data

US 2006/0006836 A1 Jan. 12, 2006

(30) Foreign Application Priority Data

Jul. 8, 2004 (DE) ..... 10 2004 033 074

(51) Int. Cl.
*H02P 23/00* (2006.01)

(52) U.S. Cl. ..... 318/807; 318/720; 318/701; 318/721; 318/729

(58) Field of Classification Search ..... 318/807, 318/720, 701, 721, 729, 811, 806, 810, 809, 318/803, 805, 723, 629, 432
See application file for complete search history.

(56) References Cited

U.S. PATENT DOCUMENTS 5,325,155 A * 6/1994 Perry ..... 399/167
5,476,158 A * 12/1995 Mann et al. ..... 187/289
5,585,709 A * 12/1996 Jansen et al. ..... 318/807
5,896,487 A * 4/1999 Masten et al. ..... 388/811
5,899,411 A * 5/1999 Latos et al. ..... 244/53 A
6,426,633 B1 * 7/2002 Thybo ..... 324/511
6,515,444 B1 * 2/2003 Jahkonen et al. ..... 318/629
6,696,811 B2 * 2/2004 Reutlinger ..... 318/606
2004/0207358 A1 * 10/2004 Tobari et al. ..... 318/717
2005/0061897 A1 * 3/2005 Lipowski ..... 241/30

FOREIGN PATENT DOCUMENTS

DE 35 32 444 C2 3/1987
DE 195 29 764 A1 2/1997
DE 196 18 723 A1 7/1997

* cited by examiner

*Primary Examiner*—Karen Masih
(74) *Attorney, Agent, or Firm*—Bacon & Thomas, PLLC

(57) ABSTRACT

On a training device, in particular for developing human muscles, having a torque-generating unit which comprises an electric motor and a reduction gearing, and whose output interacts with at least one training element offered to the exercising person, an electric motor is designed as a three phase AC motor. Associated with the latter is a frequency converter for adjusting the frequency and amperage of the three phase current supplied to the electric motor. A control unit is provided upstream of the frequency converter. An angle-of-rotation sensor is associated with the motor whose measured signal is supplied to both the frequency converter and the control unit. The frequency converter is fed by the control unit with a setpoint value of the torque to be generated by the motor which setpoint value receives the measured signal from the angle-of-rotation sensor. The frequency converter adjusts the frequency and the amperage of the motor current using the principle of field-oriented control. The control unit comprises two control circuits in cascade arrangement for controlling the position and the speed of rotation of the training element.

15 Claims, 4 Drawing Sheets

TRAINING DEVICE

FIELD OF THE INVENTION

This invention relates to a training device, in particular for developing human muscles, having a torque-generating unit which comprises an electric motor and a=reduction gearing, and whose output interacts with at least one training element offered to the exercising person, with the electric motor designed as a three phase AC motor associated with a frequency converter for adjusting the frequency and amperage of the three phase current supplied to the electric motor, and with a control unit provided upstream of the frequency converter.

BACKGROUND OF THE INVENTION

Such a training device is known from EP 0 853 961 B1. On such a training device, a computing unit supplies a frequency converter with setpoint values for the amperage and the frequency of the current of a three phase AC motor provided for generating torque. The computing unit is supplied with the output signal of a position sensor measuring the position of a motor-driven crank which acts as a training element. By means of stored tables containing all the relevant machine-specific parameters, the computing unit calculates from the position value the values of the amperage and frequency of the motor current required for a desired course of the torque over position.

This known training device works in a quite satisfactory manner, but can be further improved with regard to certain functional requirements. Especially the use of such training devices in medical rehabilitation centres thus requires both high accuracy in maintaining a desired torque and limit stops which can precisely be adjusted for the range of movement of the training element. Such limit stops are particularly significant, for example, when the maximum deflection angle of a joint of the body after surgery is to be restored to its normal value by means of workout exercises in defined steps.

A training device having a three phase AC motor for generating torque is known from FR 2 709 067 A1, where both the speed of rotation of the motor is measured by a frequency-analogue rate sensor and the torque output is measured by a force sensor. The speed of rotation measured is used for controlling the frequency and the torque measured is used for controlling the motor current. The concept of this training device thus comprises two sensors and two interconnected control loops and its implementation therefore involves relatively high design complexity. Measuring the force by a sensor further involves potential problems such as the effects of temperature, drift as well as malfunctions resulting from vibration or impacts.

SUMMARY OF THE INVENTION

With regard to this state of the art, it is the object of the present invention to provide a training device as initially described above which maintains a preset torque with a high degree of accuracy while simultaneously limiting the range of movement by precisely adjustable limit stops and which is characterised by simple and reliable design features.

According to the invention, this object is achieved by a training device having an angle-of-rotation sensor, associated with a motor, whose measured signal ($\phi_M$) is supplied to both a frequency converter and a control unit, further in that the frequency converter is fed by the control unit with a setpoint value ($M_M$) for the torque to be generated by the motor, which setpoint value receives the measured signal ($\phi$M) from the angle-of-rotation sensor, and further in that the frequency converter adjusts the frequency and amperage of the motor current using the principle of field-oriented control.

DETAILED DESCRIPTION OF THE PREFERRED EMBODIMENTS

Figure 1:
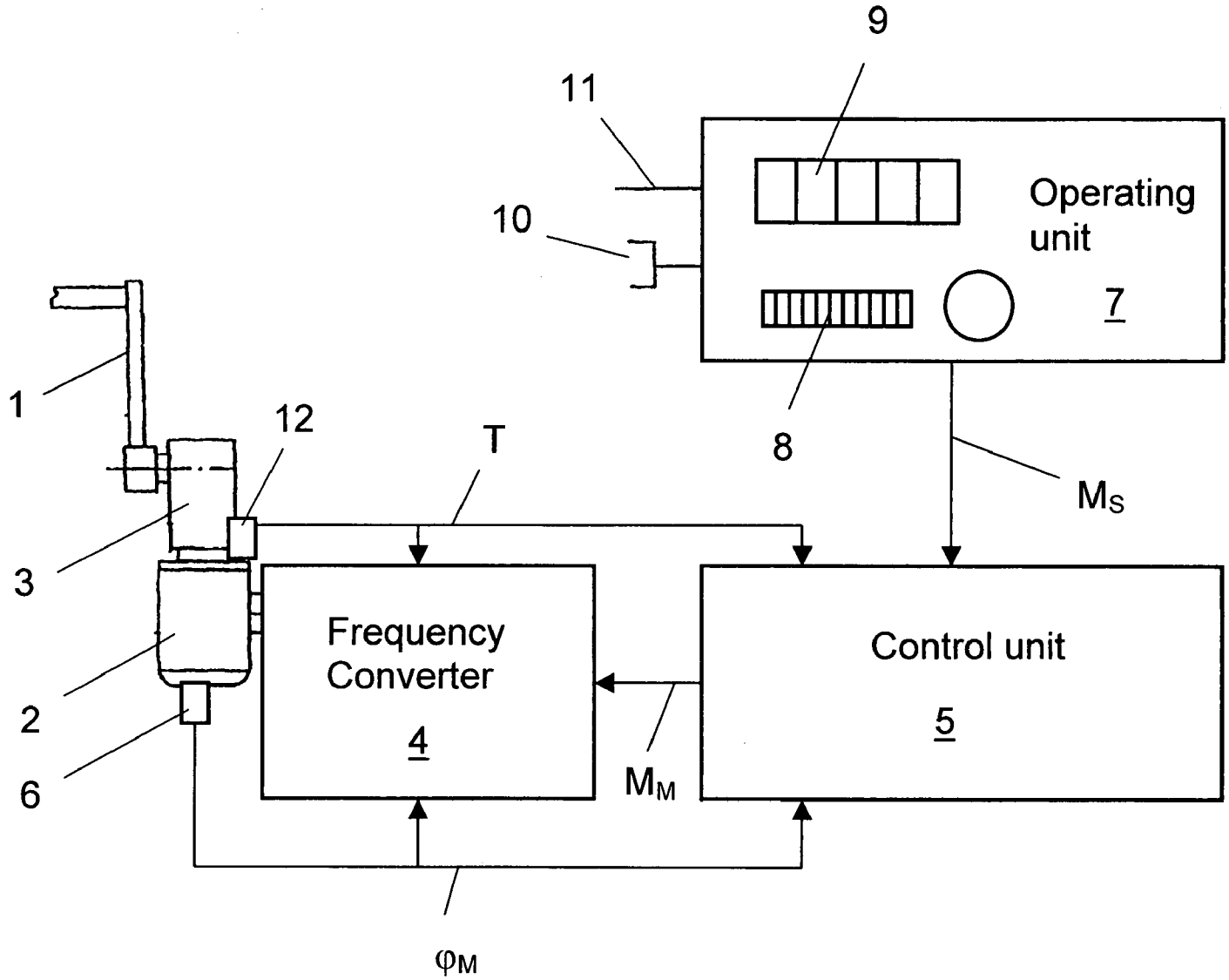
FIG. 1 shows a schematic drawing of a training device according to the invention.

The training device according to the invention stands out in that, as a measuring variable for torque control, the angle of rotation is sensed by an angle-of-rotation sensor whose measured signal is then supplied to both the frequency converter and the control unit. The frequency converter adjusts the frequency and the motor current using the principle of field-oriented control. It is true that the latter as such is a known concept of controlling an induction motor, but not in connection with training devices of the kind discussed in this context.

A significant advantage of the invention as compared to the state of the art initially described above lies in the fact that it permits a more precise control of the torque generated by the motor. This advantage is particularly enhanced by the motor being operated within the normal operating range of an induction machine, i.e. where slip is relatively small and where thus only minor manufacturing tolerance-conditioned deviations of the torque characteristic are to be expected. By contrast, the operating range of motors according to the state of the art, i. e. with a relatively high degree of slip, is subject to significantly higher such tolerance-conditioned deviations. Another advantage of the operating range according to the present invention lies in a reduced degree of power loss of the motor, whereby a considerable amount of energy is saved. Due to the reduced power loss, cooling by forced convection is not required so that the noise generated by a blower can be avoided. Finally, the fact that the angle of rotation of the motor is directly sensed instead of being calculated from a measured angle of rotation of the training element also leads to a great improvement of the dynamics of the control circuit.

In an advantageous operating mode, the control unit adjusts the position of the training element to a setpoint value, so that the user has to exert a certain amount of force in order to move the training element from its home position, and the frequency converter, on its part, adjusts the torque of the motor to the setpoint value defined by the control unit, whereby the degree of force to be exerted by the user in order to move the training element is established.

In order to preset a predetermined course of the torque depending on the angle of rotation, it will be expedient to provide a control unit having two control circuits in cascade arrangement, that is to say an outer control circuit for controlling the position, and an inner one for controlling the speed of rotation, of the training element. For this purpose an analysing unit is required which on the basis of the measured signal of the angle-of-rotation sensor calculates both the position and the speed of rotation of the training element and provides them as actual values to the two control circuits.

For safety reasons it is highly advisable to provide a limiter in the positioning control circuit which limits the setpoint speed of rotation of the training element to a maximum value, so that the motor cannot cause the training element to snap back to its predetermined setpoint position at its system-based maximum speed of rotation, in the event that the exercising person releases it or slips off.

In the interest of ergonomics, it is further advisable to provide another limiter in the positioning circuit, which limits the alteration rate of the setpoint speed of rotation of the training element to a maximum value to prevent it from performing erratic movements.

In order to use a certain function for presetting a certain course of torque depending on the position of the training element and/or its speed of rotation, provision is to be made for a corresponding transmission link in the control circuit controlling the speed of rotation, which transmission link implements such functions. Component elements of such functions may be erratic alterations of the torque in certain positions, which may simulate mechanical stops. If such position-based alterations of torque are not designed as erratic but as continuous movements, cushioned mechanical stops may be simulated in such a manner that, after a preset end position has been surpassed, the torque to be overcome by the user increases in linear progression, for example with increasing further displacement. Moreover, limit stop damping may be simulated, namely in that, after a preset end position has been surpassed, the torque is continuously increased with increasing speed of rotation.

For safety reasons it may be expedient to limit the setpoint torque of the training element to a maximum value, since this measure reduces the risk of the exercising person to overexercise and the danger to sustain injuries caused by the improper handling of the training device, in particular due to an incorrect posture or by using non-permissible means or devices.

Since the force applied by the training element to the exercising person not only depends on the torque of the motor and the reduction gearing, but in addition also on a large number of mechanical und/or thermal operational parameters, such as gearing friction, temperature of the motor and the gearing, weight of the training element, the strict maintenance of the force acting on the person who exercises on the training element requires a correction of the setpoint torque of the motor depending on the above-mentioned mechanical and/or thermal operational parameters of the device. For this purpose, a computing unit is required in the control circuit controlling the speed of rotation which, besides converting the setpoint torque of the training element into a setpoint torque of the motor, also carries out such corrections. For this purpose, the computing unit is supplied by the analysing unit with motion variables of the training element, such as of its actual position and/or its actual speed of rotation, calculated on the basis of the measured signal of the angle-of-rotation sensor, such motion variables being supplied to the computing unit as additional input variables. Thus, for example, the extent by which the weight of the training element contributes to the force is dependent on the position of the training element. The operational parameters mentioned partly also include fixed values, as for example the length of lever of the training element.

The output signal of the angle-of-rotation sensor can, after conversion into the speed of rotation of the training element, be used by the analysing unit, by a repeated temporal differentiation, to calculate the angular acceleration of the training element. Such angular acceleration gains significance if the effects of inertia are to be included in the above-mentioned correction process. Thus, the control unit may, from the angular acceleration of the training element, calculate the inertia component of the force exerted by the training element on the exercising person and take it into account as an additional mechanical operational parameter.

Finally, the essential operational parameters of a training device according to the invention also include the temperature, since the electric parameters of the motor, as well as the friction and inertia of the gearing are temperature-dependent variables. To compensate any temperature-based effects, the setpoint torque of the motor may be corrected as a function of temperature, for which purpose at least one temperature sensor for sensing the current temperature must be associated with the motor and/or the gearing. The temperature-based compensation may be carried out either together with the mechanical correction in the computing unit or in a separate compensation unit which may be integrated in the frequency converter.

An embodiment of the invention is now described below in connection with the accompanying drawings As is evident from FIG. 1, the main components of a training device according to the invention include a training element 1, for example in the form of a crank, and a three phase AC motor 2 which components are interconnected by a reduction gearing 3. The motor 2 is controlled by a frequency converter 4 controlling the frequency and the amperage of the current applied to the motor 2 so as to obtain a certain torque ($M_M$) of the latter. Input of the setpoint torque ($M_M$) of the motor 2 is provided to the frequency converter 4 by a control unit 5. For controlling purposes, the angle of rotation $\phi_M$ of the motor 2 is sensed by an angle-of-rotation sensor 6 as an actual value and supplied to both the frequency converter 4 and the control unit 5.

The setpoint value $M_S$ of the torque by which the crank 1 is to be driven is set by an operating unit 7 comprising a key panel 8 and a display unit 9. In an optional arrangement, the operating unit 7 may be provided with a magnetic card reader or chip card reader 10 for data input and/or with a bus interface 11 for networking with a host computer (not shown) which may control several training devices.

Furthermore, a temperature sensor 12 is mounted on the motor 2 and/or the gearing 3, whose temperature signal T is provided to the frequency converter 4 and/or the control unit 5 so that the influence of the temperature during the control process can be taken into account and thus be compensated for.

In contrast to the state of the art, actual value sensing for the formation of a control circuit according to the invention is based on the angle of rotation $\phi_M$ of the motor 2 and not on that of the crank 1. A further difference, which is not shown in the schematic drawing of FIG. 1, but is of decisive significance, consists in the implementation of field-oriented control of the induction motor 2 by the frequency converter 4.

Field-oriented control is an algorithm for the control of an induction motor, which algorithm runs in a frequency converter and is based on a coordinate system rotating together with the rotor of the motor. Due to what is referred to as space vector transformation, a complex current vector is obtained in this rotating coordinate system which can be split up into one component parallel to the magnetic flux and one component perpendicular to the magnetic flux. In stationary condition the current components to be controlled are equal quantities which are maintained at their respective setpoint values by digital control units. They are back-transformed into a three phase system which can be used to control the pulse width modulators of the frequency converter. The component of the motor current directed perpendicular to the magnetic flux is proportional to the torque which is supplied to the converter as a setpoint value. The motor can operate as a motor or as a generator, depending on the direction of rotation, with the energy not used up by losses being transformed into heat via brake resistors.

The principle of field-oriented control of induction motors as such is known to the art, for example from D. Schröder, "Elektrische Antriebe 2" ("Electric Drives 2"), published by Springer, 1995, Chapter 15.5, or from J. Vogel, "Elektrische Antriebstechnik" ("Electric Drive Technology"), $5^{th}$ edition, published by Hüthig, 1991, Chapter 5.2.3.3. It therefore does not need to be discussed in detail in this context, nor is it the subject of the present invention. However, it has so far not been used in induction motors of training devices, even though it affords decisive advantages particularly in this very application.

Figure 2:
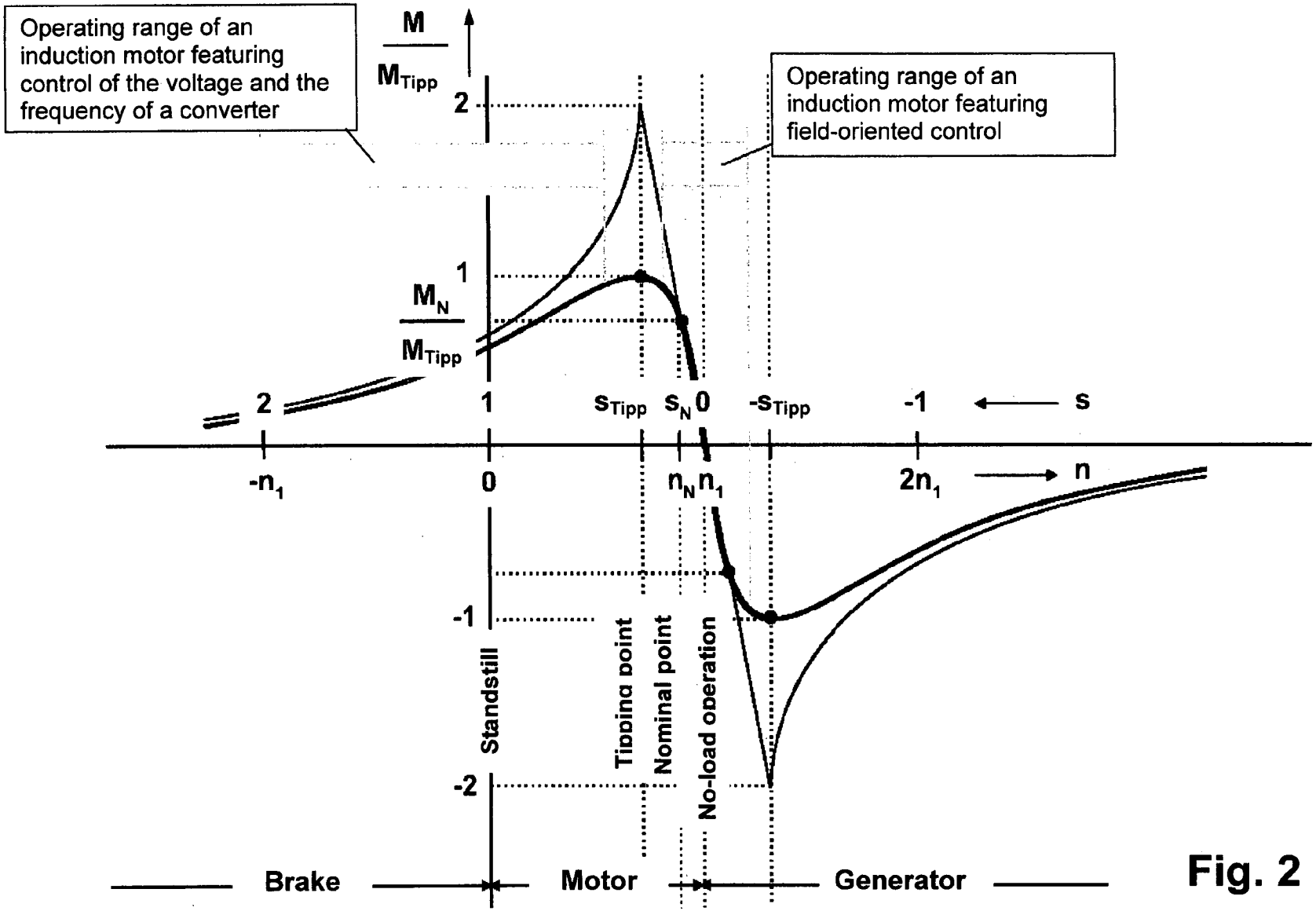
FIG. 2 shows the torque characteristic of a three phase AC motor.

This will be evident from FIG. 2 which shows the basic course of the torque characteristic of an induction motor, i.e. the course of the torque curve as a function of the speed of rotation n, or the slip s, respectively. This course of the torque characteristic as such is known and has been described in similar form in a number of books dealing with the control of electric motors, such as the two textbooks mentioned above.

Accordingly, the operating mode of an induction motor is divided into three ranges, i.e. a brake range, a motor range and a generator range, with the standstill condition marking the boundary between the brake range and the motor range, and no-load operation marking the boundary between the motor range and the generator range. The actual torque characteristic is represented by the smooth curve. Shown in addition is the straight line running through the two nominal points and two approximate curves which are valid only at some distance from the two tipping points of the curve.

FIG. 2 identifies the two ranges where an induction motor as a drive element of a training device is operated on the one hand by field-oriented control within the meaning of the present invention, and on the other hand on the basis of the initially described prior art by control of the voltage and frequency of a converter. While according to the invention the operating range between the two tipping points of the curve in the motor range and the generator range lies near the no-load point, the state of the art operating range lies around the standstill point, that is to say extends from the tipping point of the curve of the motor range far into the brake range.

It will thus be obvious that the operating range according to the invention corresponds to the normal operation of an induction motor, while the range provided according to the initially described state of the art represents a continuous operation in the starting range, as it were, and thus amounts to an inappropriate use of an induction motor, that is to say is abnormal. The problem arising in the case of a system according to the state of the art lies in the fact that the course of the torque characteristic in its relevant part is only poorly reproducible, since motor producers guarantee adherence to the rating data only within the normal operating range in the vicinity of the nominal point. In order to precisely set the torque in the aforesaid abnormal operating range, the torque characteristic would have to be measured on each individual motor, which would involve a high degree of effort and expenditure, or else, due to manufacturing tolerance-conditioned deviations of the torque characteristic, higher tolerances with a view to the accuracy of the preset torque would have to be accepted. This problem does not arise within the normal operating range, which is maintained in the case of field-oriented control, since here the rating data are accurately specified by the manufacturer.

Figure 3:
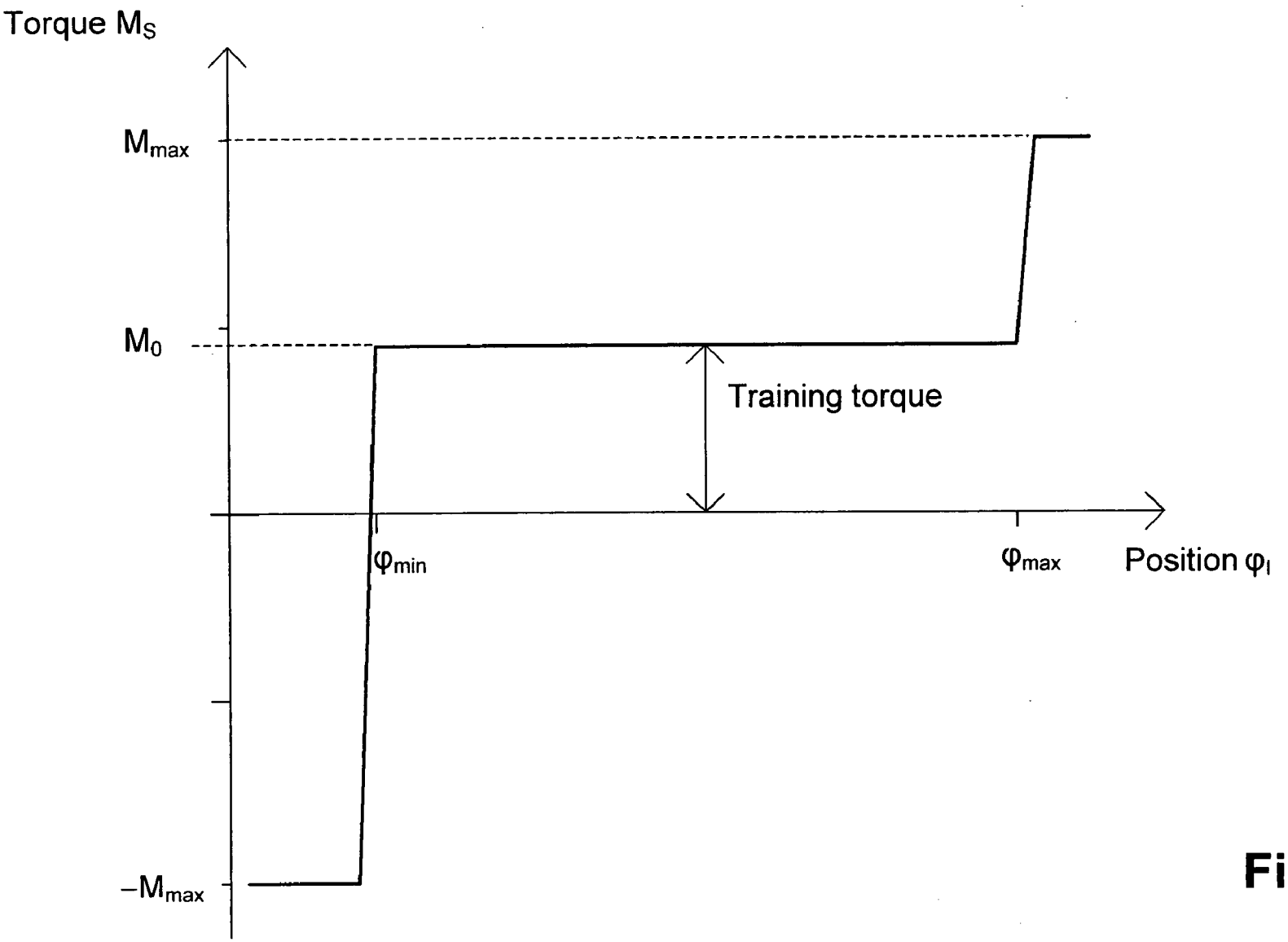
FIG. 3 shows a course of torque of a training device according to the invention as a function of the position.

Furthermore, the power loss of an induction motor is known to be much smaller in the normal operating range, i.e. at a low amount of slip than at higher slip. Due to the shift into the normal operating range as a result of the field-oriented control, the amount of heat generated is lower, so that the use of a blower is not required. A typical torque characteristic of a training device according to the invention as a function of the position of a crank 1 provided as a training element is shown in FIG. 3. The torque between the positions $\phi_{min}$ and $\phi_{max}$ constantly lies at the value $M_0$. This constant torque $M_0$ corresponds to a certain force to be exerted by the exercising person on the crank 1, in order to move it in one of the two possible rotary directions against the effect of the motor 2. The setpoint value for the position control of the crank 1 is the position $\phi_{min}$, that is to say when the exercising person releases the crank 1, the position $\phi_{min}$ is approached and maintained. In order to move the crank 1 from there in the direction of the position $\phi_{max}$, the exercising person has to overcome the torque $M_0$.

At the position $\phi_{max}$ the torque almost abruptly jumps to a considerably higher value $M_{max}$, whereby an upper mechanical stop is simulated with the aid of the motor 2 and its control. Likewise, when a torque in the opposite direction is applied to the crank 1 by the exercising person, the torque almost abruptly jumps to the negative value $-M_{max}$ at the position $\phi_{min}$, whereby a lower stop is simulated. The range of movement of the crank available to the exercising person therefore lies between the position values $\phi_{min}$ and $\phi_{max}$.

Although it is assumed in FIG. 3 that the torque between the two end positions $\phi_{min}$ and $\phi_{max}$ is to be constant at value $M_0$, it would likewise be very well conceivable to preset a position-dependent course of the torque characteristic, for example in the form of a linear increase in torque in the direction of $\phi$.

Instead of providing nearly abrupt jumps of the torque at the two end positions $\phi_{min}$ and $\phi_{max}$, it is likewise possible to make provision for a continuous alteration at a defined rate until the respective final value $-M_{max}$ or $M_{max}$ is obtained, whereby cushioned limit stops are simulated. In this case, the alteration rate may also be position-dependant which would correspond to a non-linear cushioning characteristic.

At the two end positions $\phi_{min}$ and $\phi_{max}$ in the transition range between the training torque $M_0$ and the respective final value $-M_{max}$ or $M_{max}$, the torque may further be made dependent on the speed of rotation $\omega_I$ and thus on the speed of the crank 1. This would correspond to the effect of a mechanical damper. The features of the invention can thus be used to motorically simulate the provision of limit stops of a training element with a cushion-damper system, with the degree of hardness of the cushioning or damping characteristic being adjustable by means of the operating unit 7, the card reader 10 or the bus interface 11.

The amount of the maximum torque $M_{max}$ does not necessarily correspond to the maximum torque applicable to the crank 1 by the motor 2 via the gearing 3, but is limited to a lower value to avoid the risk of injuries. It has, however, been selected sufficiently high to ensure that the exercising person, when reaching one of the two end positions $\phi_{min}$ or $\phi_{max}$, is given the impression of a mechanical stop.

To implement the course of the torque curve over the position $\phi$ as shown in FIG. 3, a control unit 5 is provided whose internal function will now be explained in conjunction with the block diagram in FIG. 4. The component parts shown on the right hand side in FIG. 4, i.e. the machine, consisting of the crank 1 and the gearing 3, the motor 2, the frequency converter 4 as well as the angle-of-rotation sensor 6 and the temperature sensor 12 correspond to the components of the training device already mentioned in conjunction with FIG. 1 and do therefore not require any further explanation.

Figure 4:
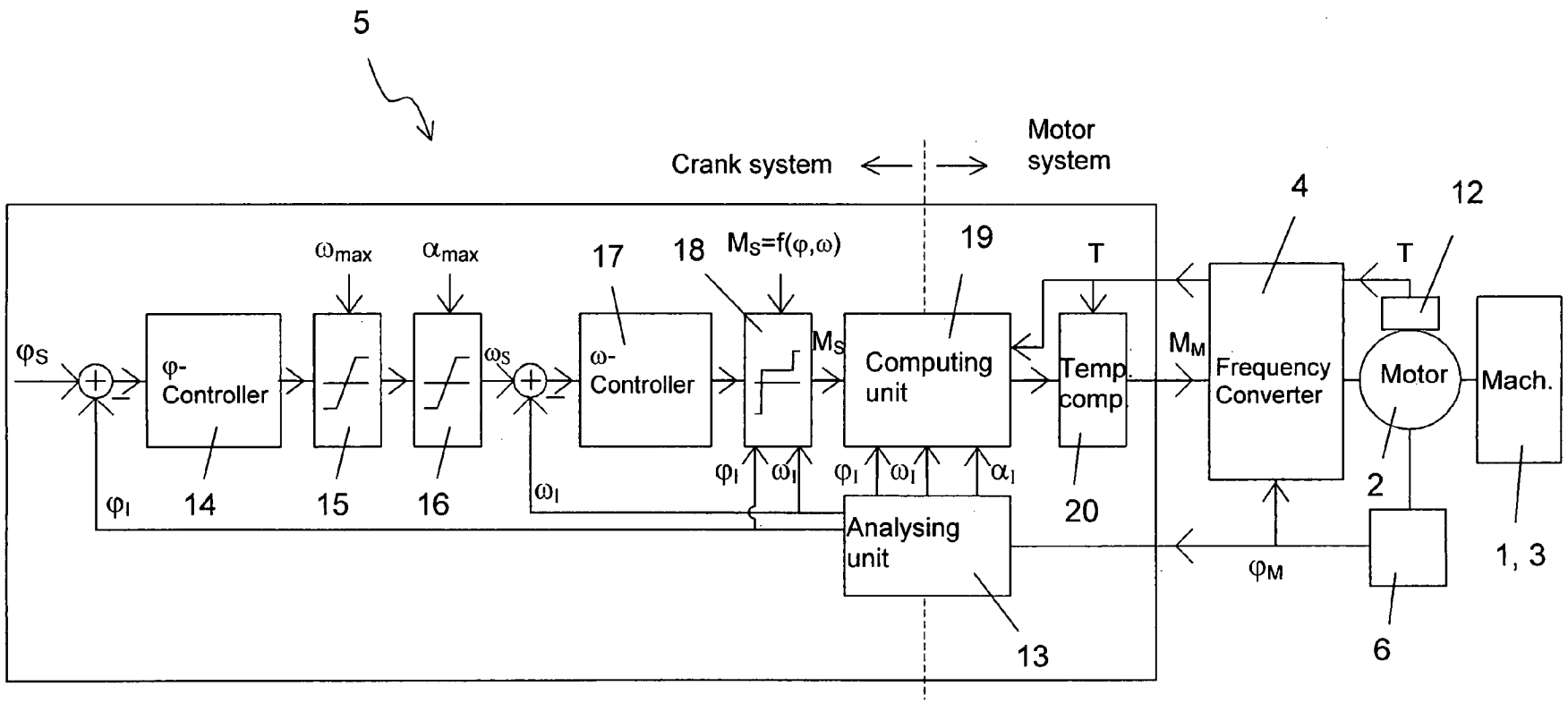
FIG. 4 shows an electric block diagram of a training device according to the invention.

The control unit 5, as is evident from FIG. 4, comprises two control circuits in cascade arrangement, i.e. an inner control circuit for the speed of rotation $\omega$ and an outer control circuit for the position $\phi$. These control circuits relate to the reference system of the training element, i.e. of the crank 1. The position in the form of an angle of rotation $\phi$ and the speed of rotation $\omega$ thus relate to the movement of the crank 1. In order to calculate the actual position $\phi_I$ and the actual speed of rotation $\omega_I$ of the crank 1 from the signal supplied by the sensor 6, which signal indicates the angle of rotation $\phi_M$ of the motor 2, an analysing unit 13 is provided which in particular includes the reduction ratio of the gearing 3 in its calculating process.

The difference between a setpoint position $\phi_S$ and the actual position $\phi_I$ is supplied to a first controller 14 which is preferably designed as a proportional controller. Here, the setpoint position $\phi_S$ corresponds to the lower end position $\phi_{min}$ shown in FIG. 3. The output of the control device 14 is a speed of rotation which is first limited to a maximum value $\omega_{max}$ by a limiter 15. Thus, the crank 1 is prevented from reaching the maximum speed attainable by the motor 2 and the gearing 3, since a great risk of injury might be involved by a sudden release, for example, by the exercising person slipping off the crank 1. A second limiter 16 limits the angle acceleration to a maximum value $\alpha_{max}$, in order to prevent an excessive jerk when the crank 1 is started at first, which, although being less dangerous, would be detrimental to training comfort. In principle, the two limiters 15 and 16 are optional, but in view of safety and comfort they are considered very useful.

The signal at the output of the second limiter 16 is a setpoint speed of rotation $\omega_S$ from which the actual speed of rotation $\omega_I$ calculated in the analysing unit 13 is subtracted. The actual speed of rotation is supplied to a speed-of-rotation controller 17, preferably designed as a proportional-plus-integral controller, which supplies a torque as an output value. In a characteristic generator 18, the torque is varied as a function of the actual position $\phi_I$ according to a defined function, for which purpose the actual position $\phi_I$ is supplied to the characteristic generator 18 as a further input value. A function which is preferred for this purpose and which comprises three constant sections and two equally high steps between such sections has been explained above in conjunction with FIG. 3.

In principle, the characteristic generator 18 might very well define a different course of the torque characteristic as a function of the actual position $\phi_I$ than that shown in FIG. 3. In particular, the alterations within the range of the two end positions $\phi_{min}$ and $\phi_{max}$ might be continuous with a view to obtaining a damping effect, rather than erratic. Furthermore, provision could be made for an additional dependence on the actual speed of rotation $\phi_I$, likewise with a view to obtaining a damping effect. The output of the characteristic generator 18 is the setpoint torque $M_S$ for the crank 1.

Since the frequency converter 4 requires a setpoint torque $M_M$ as an input for the motor 2, the setpoint torque $M_S$ for the crank 1, supplied by the characteristic generator 18 has to be converted by a computing unit 19 into the aforesaid setpoint torque $M_M$ for the motor 2. First, the reduction ratio of the gearing 3 is integrated in such conversion. Furthermore, the computing unit 19 comprises a memory storing tables which describe the influence of further mechanical system parameters on the interrelationship between the two setpoint torque values $M_S$ and $M_M$. These parameters include, for example, the weight of the crank, the frictional losses of the gearing, the inertia of the gearing and of the crank, the viscosity of the gearbox oil and the dependence on temperature of the latter.

The parameters applied to the interrelationship between the two torque values $M_S$ and $M_M$ are partly constant, but are partly also dependent on movement values and/or the temperature. For this reason, the computing unit 19 is supplied by the analysing unit 13 with at least the actual position $\phi_I$ and the actual speed of rotation $\omega_I$ of the crank 1, optionally also with the actual angle acceleration $\alpha_I$ which is required for taking into account the effects of inertia. Moreover, the computing unit is supplied with the measured signal T of the temperature sensor 12, so that temperature-based effects can be compensated for.

During the process of converting the setpoint torque $M_S$ of the crank 1 into a corresponding setpoint torque $M_M$ of the motor 2, the computing unit 19 at the same time carries out corrections compensating for additional mechanical and thermal effects which, in addition to the reduction ratio of the gearing, are further included in the conversion of the torque of the motor 2 into that of the crank 1.

With regard to temperature, compensation of the effect thereof may be divided up between the computing unit 19 and a separate compensation unit 20 or the frequency converter 4, and preferably in such a manner that compensation for the temperature dependence of the motor 2 alone is already integrated in the frequency converter 4 or else carried out by a separate compensation unit 20, since such temperature dependence is a motor-specific characteristic. The compensation unit 20 would thus be an optional feature and depend on whether or not the frequency converter 4 used in the system provides for an internal compensation of the motor temperature.

As far as the computing unit 19 includes a temperature compensation feature, the latter is preferably limited to the temperature dependence of the mechanical components arranged downstream of the motor 2, in particular the gearing 3 where the viscosity of the oil and thus friction and inertia are dependent on temperature.

There is a wide variety of parameters that may be incorporated in the correction capabilities of the computing unit 19. Thus, it is very well conceivable, for example, to associate an hours-of-operation counter with the computing unit 19, to make a prediction as regards the mechanical wear of certain components as a function of the period of operation, using a mathematic model as a basis, and to correspondingly modify the setpoint torque $M_M$ for the purpose of compensating for such wear effects in the course of time.

It is further possible to design the length of the lever arm of the crank 1 in such a variable manner that it can be adapted to the body measurements of the exercising person. In this case the force exerted by the crank 1 in a tangential direction, which is the decisive criterion for the physiotherapeutic effect of the training, depends on the length of the lever, so that for setting a certain force for any point of such variable length of lever the torque has to be corrected accordingly. In any such case, the body size may be communicated to the training device via the magnetic card reader or chip card reader 10, whereupon the length of the lever is suitably adjusted by a servo motor and the computing unit 19 selects a certain logical record from those stored in its memory, so that the adjusted length of lever can be duly taken into account.

The setpoint torque $M_M$ of the motor 2, which has been converted from the torque $M_S$ of the crank 1 and corrected, is supplied to the frequency converter 4 as an input quantity. The frequency converter independently controls the motor 2 on the principle of field-oriented control as described earlier above, and thus, together with the motor 2, forms a subordinated further control circuit. For this purpose, the frequency converter requires the measured signal of the angle-of-rotation sensor 6 on the shaft of the motor 2 which is directly supplied to the frequency converter. Since the control circuit formed by the frequency converter 4 is based on measuring a direct state variable of the motor, namely the angle of rotation $\phi_M$ of the motor, such innermost control circuit reacts very fast. This is of great advantage for the dynamic properties and stability of the entire control cycle. Frequency converters for three phase AC motors based on the principle of field-oriented control are currently available on the drive electronics market. Their use in a training device, however, is a novelty which is proposed here for the first time.

The training element, which is subjected to a force exerted by the user of the training device during training and which has been described in the embodiment above, is a crank. Any person skilled in the art will easily realise that the training element may have many different forms, such as that of a bow-shaped grip, a handle or the like or of one or two pedals. The present invention shall not be limited to a crank, but comprises all conceivable kinds of variants of a training element to which a person can apply muscle force. These likewise include, among other things, training elements which do not carry out a rotational but a translatory motion which latter will then be mechanically converted into the rotation of a motor shaft. In this case, the terms used here for angle of rotation, speed of rotation and torque shall correspond to the terms for translatory shift or translatory speed, or force, respectively. Any such variations which are obvious to a person skilled in the art shall be protected by the claims hereof.

The invention claimed is:

1. A training device, in particular for developing human muscles, having:

a torque-generating unit which comprises an electric motor and a=reduction gearing, and whose output interacts with at least one training element offered to the exercising person, with said electric motor designed as a three phase AC motor associated with a frequency converter for adjusting the frequency and amperage of the three phase current supplied to said electric motor, and with a control unit provided upstream of said frequency converter;

an angle-of-rotation sensor associated with said motor whose measured signal ($\phi_M$) is supplied to both said frequency converter and said control unit wherein:

said frequency converter is fed by said control unit with a setpoint value ($M_M$) for the torque to be generated by said motor, which setpoint value receives the measured signal ($\phi_M$) from said angle-of-rotation sensor, and said frequency converter adjusts the frequency and amperage of the motor current using the principle of field-oriented control.

2. A training device, in particular for developing human muscles, having:

a torque-generating unit which comprises an electric motor and a reduction gearing, and whose output interacts with at least one training element offered to the exercising person, with said electric motor designed as a three phase AC motor associated with a frequency converter for adjusting the frequency and amperage of the three phase current supplied to said electric motor, and with a control unit provided upstream of said frequency converter;

an angle-of-rotation sensor associated with said motor whose measured signal ($\phi_M$) is supplied to both said frequency converter and said control unit wherein:

said frequency converter is fed by said control unit with a setpoint value ($M_M$) for the torque to be generated by said motor, which setpoint value receives the measured signal ($\phi_M$) from said angle-of-rotation sensor, said frequency converter adjusts the frequency and amperage of the motor current using the principle of field-oriented control, and said control unit comprises two control circuits in cascade arrangement for controlling the position and the speed of rotation of said training element, and further comprises an analysing unit which on the basis of the measured signal ($\phi_M$) of said angle-of-rotation sensor calculates at least the position ($\phi_I$) and the speed of rotation ($\omega_I$) of said training element and provides them as actual values to said two control circuits.

3. The training device according to claim 2, wherein:

in said positioning control circuit provision is made for a first limiter which limits the setpoint speed of rotation ($\omega_S$) of said training element to a maximum value ($\omega_{max}$).

4. The training device according to claim 3, wherein:

in said positioning control circuit provision is made for a second limiter which limits the alteration rate of the setpoint speed of rotation ($\omega_S$) of said training element to a maximum value ($\alpha_{max}$).

5. The training device according to claim 2, wherein:

in said control circuit controlling the speed of rotation provision is made for a transmission link which varies the setpoint torque ($M_S$) of said training element according to a predetermined function depending on the position ($\phi_I$) and/or the speed of rotation ($\omega_I$).

6. The training device according to claim 5, wherein:

the predetermined function contains an increase in the value of the setpoint torque ($M_S$) of said training element at a defined rate in the event that at least one defined end position ($\phi_{min}$; $\phi_{max}$) of said training element is increasingly exceeded in a downward or upward direction, respectively.

7. The training device according to claim 5, wherein:

the predetermined function contains an increase in the value of the setpoint torque ($M_S$) of said training element at an increasing speed of rotation ($\omega_I$) in the event that at least one defined end position ($\phi_{min}$; $\phi_{max}$) of said training element is exceeded in a downward or upward direction, respectively.

8. The training device according to claim 5, wherein:

the predetermined function contains a limitation of the setpoint torque ($M_S$) to a predetermined maximum value ($M_{max}$).

9. The training device according to claim 2, wherein:

said control circuit controlling the speed of rotation provision is made for a computing unit which converts the setpoint torque ($M_S$) of said training element into a setpoint torque ($M_M$) of said motor and corrects the latter depending on certain mechanical and/or thermal operational parameters of the training device.

10. The training device according to claim 9, wherein:

said computing unit is supplied by an analysing unit with motion=variables ($\phi_I$, $\omega_I$, $\alpha_I$) of said training element, in particular of its actual position ($\phi_I$) and/or its actual speed of rotation ($\omega_I$), calculated on the basis of the measured signal ($\phi_M$) of said angle-of-rotation sensor, such motion variables being supplied to said computing unit as additional input variables, and incorporated by it in the process of correcting the setpoint torque ($M_M$) of said motor.

11. The training device according to claim 10, wherein:

the motion variables calculated by said analysing unit, which are supplied to said computing unit and incorporated by it in the process of correcting the setpoint torque ($M_M$) of said motor, also include the angle acceleration ($\alpha_I$) of said training element.

12. The training device according to claim 9, wherein:

at least one temperature sensor is associated with said motor and/or said gearing, whose measured signal (T) is supplied to said computing unit and/or a separate compensation unit as an input variable, and used there for a temperature-based correction of the setpoint torque ($M_M$) of said motor.

13. The training device according to claim 9, wherein:

provision is made for a compensation unit for the correction of the temperature effect on said motor, which compensation unit is arranged separately from said computing unit and is integrated in said frequency converter.

14. A training device, in particular for developing human muscles, having:

a torque-generating unit which comprises an electric motor and a=reduction gearing, and whose output interacts with at least one training element offered to the exercising person, with said electric motor designed as a three phase AC motor associated with a frequency converter for adjusting the frequency and amperage of the three phase current supplied to said electric motor, and with a control unit provided upstream of said frequency converter;

an angle-of-rotation sensor associated with said motor whose measured signal ($\phi_M$) is supplied to both said frequency converter and said control unit wherein:

said frequency converter is fed by said control unit with a setpoint value ($M_M$) for the torque to be generated by said motor, which setpoint value receives the measured signal ($\phi_M$) from said angle-of-rotation sensor, said frequency converter adjusts the frequency and amperage of the motor current using the principle of field-oriented control, said control unit adjusts the position of said training element to a setpoint value ($\phi_{min}$), and said frequency converter adjusts the torque of said motor to the setpoint value ($M_M$) predetermined by said control unit.

15. A training device, in particular for developing human muscles, having:

a torque-generating unit which comprises an electric motor and a=reduction gearing, and whose output interacts with at least one training element offered to the exercising person, with said electric motor designed as a three phase AC motor associated with a frequency converter for adjusting the frequency and amperage of the three phase current supplied to said electric motor, and with a control unit provided upstream of said frequency converter;

an angle-of-rotation sensor associated with said motor whose measured signal ($\phi_M$) is supplied to both said frequency converter and said control unit, and and means to mechanically convert translatory motion into rotary motion, wherein:

said frequency converter is fed by said control unit with a setpoint value ($M_M$) for the torque to be generated by said motor, which setpoint value receives the measured signal ($\phi_M$) from said angle-of-rotation sensor, and said frequency converter adjusts the frequency and amperage of the motor current using the principle of field-oriented control, and said training element is arranged for translatory motion and that said means to mechanically convert the translatory motion into a rotary motion of the shaft of the electric motor, is such that on the side of said training element the motion variables represent distance, speed and force instead of angle of rotation, speed of rotation and torque, respectively.

* * * * *